US006692100B2

(12) United States Patent
Steinfield et al.

(10) Patent No.: US 6,692,100 B2
(45) Date of Patent: Feb. 17, 2004

(54) CLEANING APPARATUS AND METHOD OF ASSEMBLY THEREFOR FOR CLEANING AN INKJET PRINT HEAD

(75) Inventors: Steven W Steinfield, San Diego, CA (US); Lidia Calvo, San Diego, CA (US); Benjamin H Wood, San Diego, CA (US); Antonio Monclus, Castelldefels Barcelona (ES); Daniel Laborce, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/116,999

(22) Filed: Apr. 5, 2002

(65) Prior Publication Data

US 2003/0189614 A1 Oct. 9, 2003

(51) Int. Cl.[7] ..... B41J 2/165
(52) U.S. Cl. ..... 347/22; 347/29; 347/33
(58) Field of Search ..... 347/22, 28, 29, 347/33, 104; 400/613; 101/228, 227; 226/190

(56) References Cited

U.S. PATENT DOCUMENTS

| | | | | |
|---|---|---|---|---|
| 3,946,398 A | | 3/1976 | Kyser et al. | 347/70 |
| 4,369,456 A | * | 1/1983 | Cruz-Uribe et al. | 347/33 |
| 4,381,946 A | | 5/1983 | Uehara et al. | 106/22 |
| 4,500,895 A | | 2/1985 | Buck et al. | 347/87 |
| 4,771,295 A | | 9/1988 | Baker et al. | 347/93 |
| 4,794,409 A | | 12/1988 | Cowger et al. | 347/87 |
| 4,928,120 A | | 5/1990 | Spehrley, Jr. et al. | |
| 5,278,584 A | | 1/1994 | Keefe et al. | 347/63 |
| 5,300,958 A | | 4/1994 | Burke et al. | 347/28 |
| 5,487,728 A | | 1/1996 | Vaillancourt | 604/86 |
| 5,489,927 A | | 2/1996 | Harmon | 347/33 |
| 5,500,660 A | | 3/1996 | Childers et al. | 347/33 |
| 5,507,226 A | * | 4/1996 | Burke et al. | 101/228 |
| 5,583,548 A | | 12/1996 | Kearns | 347/33 |
| 5,602,573 A | | 2/1997 | Waschhauser et al. | 347/33 |
| 5,745,133 A | | 4/1998 | Hendricks et al. | 347/33 |
| 5,815,176 A | | 9/1998 | Rotering | 347/33 |
| 5,907,335 A | | 5/1999 | Johnson et al. | 347/28 |
| 5,969,731 A | | 10/1999 | Michael et al. | |
| 5,997,128 A | | 12/1999 | Lou et al. | 347/33 |
| 6,155,666 A | | 12/2000 | Sugimoto et al. | 347/24 |
| 6,193,537 B1 | | 2/2001 | Harper, Jr. et al. | 439/291 |
| 6,206,499 B1 | | 3/2001 | Iijima et al. | 347/33 |
| 6,231,168 B1 | | 5/2001 | Maze et al. | 347/65 |
| 6,290,324 B1 | | 9/2001 | Jackson et al. | 347/33 |

FOREIGN PATENT DOCUMENTS

| | | | | |
|---|---|---|---|---|
| EP | 0558219 | | 9/1993 | |
| EP | 0856404 | | 8/1998 | |
| EP | 1080909 A1 | | 3/2001 | |
| JP | 3189163 | | 8/1991 | |
| JP | 405064895 | * | 3/1993 | 347/33 |

OTHER PUBLICATIONS

Hewlett–Packard Jounal, Aug. 1988 pp. 1–88, various authors.

Patent Abstract of Japan, Inventor–Martin Guraife, entitled Method and Apparatus for Cleaning Printing Head of Ink–jet Printer, publication date Jan. 23, 2001, publication No. 2001018409, 1 page.

* cited by examiner

*Primary Examiner*—Shih-Wen Hsieh
(74) *Attorney, Agent, or Firm*—Walter S. Stevens

(57) ABSTRACT

Cleaning apparatus and method of assembly therefor for cleaning an inkjet print head. The cleaning apparatus comprises a web supply for supplying a cleaning web therefrom and a web receiver for receiving the web. A web drive drives the web from the web supply to the web receiver. The web drive pulls the web from the web supply with a first tension force and also pulls the web onto the web receiver with a second tension force greater than the first tension force, so that the web is wrinkle-free while the web slidably engages an exterior surface of the print head to clean the print head. The web remains wrinkle-free to ensure that the surface of the web will contact the surface of the print head without gaps in contact coverage. This enhances cleaning effectiveness compared to a cleaning web having wrinkles.

12 Claims, 11 Drawing Sheets

CLEANING APPARATUS AND METHOD OF ASSEMBLY THEREFOR FOR CLEANING AN INKJET PRINT HEAD

BACKGROUND OF THE INVENTION

This invention generally relates to print head cleaning apparatus and methods and more particularly relates to a cleaning apparatus and method of assembly therefor for cleaning an inkjet print head.

An ink jet printer produces images on a recording medium by ejecting ink droplets onto the recording medium in an image-wise fashion. The advantages of non-impact, low-noise, low energy use, and low cost operation in addition to the ability of the printer to print on plain paper are largely responsible for the wide acceptance of ink jet printers in the marketplace.

More specifically, an ink jet printer comprises a print head cartridge that includes a plurality of ink ejection chambers and a plurality of ink ejection orifices in communication with respective ones of the ink ejection chambers. At every orifice an ink ejector is used to produce an ink droplet. In this regard, either one of two types of ink ejectors may be used. These two types of ink ejectors are heat actuated ink ejectors and piezoelectric actuated ink ejectors. With respect to piezoelectric actuated ink ejectors, a piezoelectric material is used. The piezoelectric material possesses piezoelectric properties such that an electric field is produced when a mechanical stress is applied. The converse also holds true; that is, an applied electric field will produce a mechanical stress in the material. When a piezoelectric actuated ink ejector is used for inkjet printing, an electric pulse is applied to the piezoelectric material causing the piezoelectric material to bend, thereby squeezing an ink droplet from an ink body in contact with the piezoelectric material. The ink droplet thereafter travels through the ink ejection orifice and lands on the recording medium. One such piezoelectric inkjet printer is disclosed by U.S. Pat. No. 3,946,398 titled "Method And Apparatus For Recording With Writing Fluids And Drop Projection Means Therefor" issued Mar. 23, 1976 in the name of Edmond L. Kyser, et al.

With respect to heat actuated ink ejectors, such as found in thermal ink jet printers, a heater locally heats the ink body and a quantity of the ink phase changes into a gaseous steam bubble. The steam bubble raises the internal ink pressure sufficiently for an ink droplet to be expelled through the ink ejection orifice and toward the recording medium. Thermal inkjet printers are well-known and are discussed, for example, in U.S. Pat. No. 4,500,895 to Buck, et al.; U.S. Pat. No. 4,794,409 to Cowger, et al.; U.S. Pat. No. 4,771,295 to Baker, et al.; U.S. Pat. No. 5,278,584 to Keefe, et al.; and the Hewlett-Packard Journal, Vol.39, No. 4 (Aug. 1988), the disclosures of which are all hereby incorporated by reference.

The print head cartridge itself may be a carriage mounted print head cartridge that reciprocates transversely with respect to the recording medium (i.e., across the width of the recording medium) as a controller connected to the print head cartridge selectively fires individual ones of the ink ejection chambers. Each time the print head traverses the recording medium, a swath of information is printed on the recording medium. After printing the swath of information, the printer advances the recording medium the width of the swath and the print head cartridge prints another swath of information in the manner mentioned immediately hereinabove. This process is repeated until the desired image is printed on the recording medium. Alternatively, the print head cartridge may be a page-width print head cartridge that is stationary and that has a length sufficient to print across the width of the recording medium. In this case, the recording medium is moved continually and normal to the stationary print head cartridge during the printing process.

Inks useable with piezoelectric and thermal ink jet printers, whether those printers have carriage-mounted or page-width print head cartridges, are specially formulated to provide suitable images on the recording medium. Such inks typically include a colorant, such as a pigment or dye, and an aqueous liquid, such as water, and/or a low vapor pressure solvent. More specifically, the ink is a liquid composition comprising a solvent or carrier liquid, dyes or pigments, humectants, organic solvents, detergents, thickeners, preservatives and other components. Moreover, the solvent or carrier liquid may be water alone or water mixed with water miscible solvents such as polyhydric alcohols, or organic materials such as polyhydric alcohols. Various liquid ink compositions are disclosed, for example, by U.S. Pat. No. 4,381,946 titled "Ink Composition For Ink-Jet Recording" issued May 3, 1983 in the name of Masafumi Uehara, et al.

Such inks for inkjet printers, whether of the piezoelectric or thermal type, have a number of special characteristics. For example, the ink should incorporate a nondrying characteristic, so that drying of the ink in the ink ejection chambers is hindered or slowed to such a state that by occasional spitting of ink droplets, the ejection chambers and corresponding orifices are kept open and free of dried ink. However, it has been observed that ink can builds-up on the print head and electrical interconnect of the print head. This ink build-up can result from the following three main sources: (1) ink puddling and splatter as ink is ejected; (2) ink aerosol condensation on the print head; and (3) ink redeposited by a service station cap and wiper. Such ink build-up may lead to the following undesirable results: (1) wet ink shorting the electrical interconnect of the print head thereby causing electrical malfunction of the print head; (2) paper fiber tracks causing unwanted lines of ink on the recording medium due to dragging of wet paper fibers stuck to the ink on the print head; (3) poor ink ejection orifice performance causing drop ejection errors, and drop velocity or drop volume degradation; and (4) ink drops falling-off the print head causing unwanted ink spots on the recording medium.

In addition, the inkjet print head cartridge is exposed to the environment where the inkjet printing occurs. That is, the previously mentioned ink ejection orifices are exposed to many kinds of air born particulates, such as dust, dirt and the previously mentioned paper fibers. Particulate debris may accumulate on surfaces formed around the orifices and may accumulate in the orifices and chambers themselves. That is, the ink may combine with such particulate debris to form an interference burr that blocks the orifice or that alters surface wetting to inhibit proper formation of the ink droplet. Blocking the orifice interferes with proper ejection of ink droplets, thereby altering the flight path of the ink droplets and causing the ink droplets to strike the recording medium in unintended locations. The particulate debris and ink build-up should be cleaned from the print head surface and orifice to restore proper droplet formation and proper ink droplet trajectory.

For all the foregoing reasons, it is important to clean the print head of unwanted ink and debris. In some prior art devices, this cleaning is accomplished by wiping the print head or by absorbing ink and debris from the print head.

A representative inkjet print head cartridge cleaner using a wiper blade to wipe the print head is disclosed by U.S. Pat.

No. 5,907,335 titled "Wet Wiping Printhead Cleaning System Using A Non-Contact Technique For Applying A Printhead Treatment Fluid" issued May 25, 1999 in the name of Eric Joseph Johnson, et al. and assigned to the assignee of the present invention. The Johnson, et al. patent discloses cleaning in printers employing a "wiper" blade, which slidingly engages and wipes a nozzle orifice plate surface of a print head cartridge to remove excess ink and accumulated debris. Removal of excess ink and accumulated debris is intended to improve print head performance and print quality. According to the Johnson, et al. disclosure, the cleaning system comprises a print head service station including a source of treatment fluid located near a cap belonging to the service station. The cap is brought into sealing contact with the print head. A wiper, which is included in one embodiment of the service station, comes into contact with the print head for removing dried ink and debris. The treatment fluid lubricates the wiper to reduce wear of the wiper. Also, the treatment fluid dissolves some of the dried ink residue accumulated on the print head. In addition, the treatment fluid leaves a thin film, which does not readily dry, so that ink residue and other debris subsequently deposited on the print head over the layer of the fluid are more easily wiped-off. Scrappers are provided within the service station to clean the wipers.

Another technique for cleaning an inkjet print head is disclosed in Japanese Patent JP 3-189163 titled "Ink Jet Recorder" issued Aug. 19, 1989 to Canon, Incorporated. The Canon patent discloses a method of removal of paper powder, dust, ink or the like from the front discharge portion of a print head. More specifically, when the print head is positioned at a cleaning location in the printer by means of a carriage motor, the print head is pushed into contact with a ribbon of porous material. Ink, bubbles, e.t.c. are absorbed from the discharge portion of the print head by capillary action between the discharge portion and the porous material. The amounts of ink, bubbles, e.t.c., that may contain paper powder or dust, are absorbed in proportion to contact time with the porous material. After cleaning, the print head is then returned to a printing position by operation of the carriage motor. After confirming that the print head is no longer at the cleaning location, the porous material is advanced to ready another portion of the porous material for the next cleaning event.

Although prior art print head cartridge cleaning techniques, such as disclosed by the Johnson, et al. patent, may function satisfactorily, it has been observed that ink will build-up on the wiper over time. This results in diminished effectiveness of the wiper over the life of the wiper. Although scrapers, such as disclosed by the Johnson et al. patent, are sometimes provided to clean the wiper, use of scrappers do not eliminate the root cause of the problem and can themselves experience ink build-up that diminishes scraper effectiveness over time. Moreover, although the Canon patent discloses a porous material for removal of ink, bubbles, e.t.c. that may contain paper powder or dust, there is apparently no disclosure in the Canon patent that the porous material remains wrinkle-free in order to enhance cleaning effectiveness when the porous material is brought into contact with the print head. Also, according to the Canon patent, the porous material must remain in contact with the print head for a specified time to satisfactorily absorb ink, bubbles, paper powder or dust by the relatively slow process of capillary action. Use of the Canon cleaning technique therefore increases cleaning time.

Therefore, what is needed is a cleaning apparatus and method of assembly therefor for cleaning an inkjet print head, which apparatus and method (1) eliminate need for wipers and scrapers, yet removes ink build-up and particulate debris from the exterior surface of the print head to avoid wet ink shorting the electrical interconnect of the print head; (2) remove paper fiber tracks causing unwanted lines of ink on the recording medium; (3) improve poor ink ejection orifice performance that otherwise cause drop ejection errors, drop velocity or drop volume degradation; (4) reduce risk of ink drops falling-off the print head causing unwanted ink spots on the recording medium; and (5) avoid reliance on the relatively slow process of capillary action to clean the print head.

SUMMARY OF THE INVENTION

In a broad form, the invention is a cleaning apparatus and method of assembly therefore for cleaning an inkjet print head. The cleaning apparatus comprises a web supply for supplying a web therefrom. A web receiver is associated with the web supply for receiving the web, the web being capable of extending from the web supply to the web receiver and slidably engaging the print head for cleaning the print head. A web drive is associated with the web supply and the web receiver for driving the web from the web supply to the web receiver. The web drive is adapted to pull the web from the web supply with a first tension force and to pull the web onto the web receiver with a second tension force greater than the first tension force, so that the web is wrinkle-free while the web slidably engages the print head.

According to an aspect of the present invention, the cleaning apparatus comprises a web supply wound about a freely rotatable first spindle. Disposed proximate the first spindle is a web receiver comprising a rotatable second spindle for receiving the web thereon. In this manner, the web extends from the first spindle to the second spindle while the web slidably engages the exterior surface of the print head for cleaning the surface of the print head.

The cleaning apparatus further comprises a web drive coupled to the second spindle for driving the web from the freely rotatable first spindle to the second spindle. In this regard, the web drive comprises a drive roller concentrically mounted on a third spindle disposed proximate the first spindle. A portion of the web extending from the first spindle wraps partially around the drive roller, so that the web is pulled from the first spindle as the drive roller rotates. The web drive is also coupled to the second spindle. That is, the web drive simultaneously pulls the web onto the second spindle as the drive roller, which belongs to the web drive, pulls the web from the first spindle. In other words, the web drive both pulls the web from the web supply and pulls the web onto the web receiver. Moreover, it is the portion of the web that is wrapped partially around the drive roller that engages the print head surface for cleaning the print head surface.

The web drive further comprises a gear train for controllably rotating the second spindle (web receiver) and the third spindle (drive roller). Coupled to the second spindle is an adjustable overdrive slip clutch. The overdrive slip clutch is adjustable for applying a predetermined amount of sliding friction to the second spindle to control speed of rotation of the second spindle. Controlling speed of rotation of the second spindle will control the forward tension acting on the web. In this regard, the overdrive slip clutch can be adjusted to apply a desired forward tension force acting on the web. Moreover, the portion of the web that partially wraps around the drive roller effectively functions as a "passive slip clutch" arrangement. The passive slip clutch arrangement applies a predetermined amount of friction between the drive roller and the web, depending on a predetermined "wrap angle" (i.e., angle formed by the web as it wraps partially around the drive roller), so that the drive roller moves the web without slippage. In this regard, the passive slip clutch arrangement applies a desired back tension force acting on the web. Adjustment of the overdrive slip clutch and presence of the passive slip clutch allows the overdrive slip clutch and the passive slip clutch to cooperatively act to hold the web in tension, so that the web remains wrinkle-free. It is important that the web remains wrinkle-free. This is important to ensure that the surface of the web will contact the surface of the print head without gaps in contact coverage. This enhances cleaning effectiveness compared to a web having wrinkles.

An actuator is also provided for actuating the gear train. Actuating the gear train in turn rotates the second spindle and the drive roller a predetermined amount. In this regard, after the print head is sufficiently cleaned by the web, the actuator indexes the web by rotating the second spindle and the drive roller the predetermined amount in order to present an unused portion of the web for the next cleaning event.

The cleaning apparatus further includes a plurality of conventional spittoons for receiving ink ejected or "spit" from the cartridge orifices to clear the orifices of dried ink and debris. The cleaning apparatus also includes a plurality of conventional capping stations for capping the orifices when the print head is not in use, so that risk of ink dry-out is reduced. Thus, the cleaning apparatus may inventively include traditional spittoons and/or capping stations in combination with the web and web drive for enhanced cleaning effectiveness.

A feature of the present invention is the provision of a web capable of slidably engaging the print head for cleaning the print head.

Another feature of the present invention is the provision of a web drive to precisely drive the web, so that the web is wrinkle-free while the web slidably engages the print head.

An advantage of the present invention is that use thereof eliminates need for wipers and scrapers, yet removes ink build-up and particulate debris from the exterior surface of the print head.

Another advantage of the present invention is that use thereof (1) avoids wet ink shorting the electrical interconnect in the print head; (2) removes paper fiber tracks causing unwanted lines of ink on the recording medium; (3) improves poor ink ejection orifice performance that otherwise cause drop ejection errors, drop velocity or drop volume degradation; and (4) reduces risk of ink drops falling-off the print head causing unwanted ink spots on the recording medium.

Yet another advantage of the present invention is that use thereof reduces cleaning time.

These and other features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENT

The present invention will be directed in particular to elements forming part of, or cooperating more directly with, apparatus in accordance with the present invention. It is to be understood that elements not specifically shown or described may take various forms well known to those skilled in the art.

Figure 1:
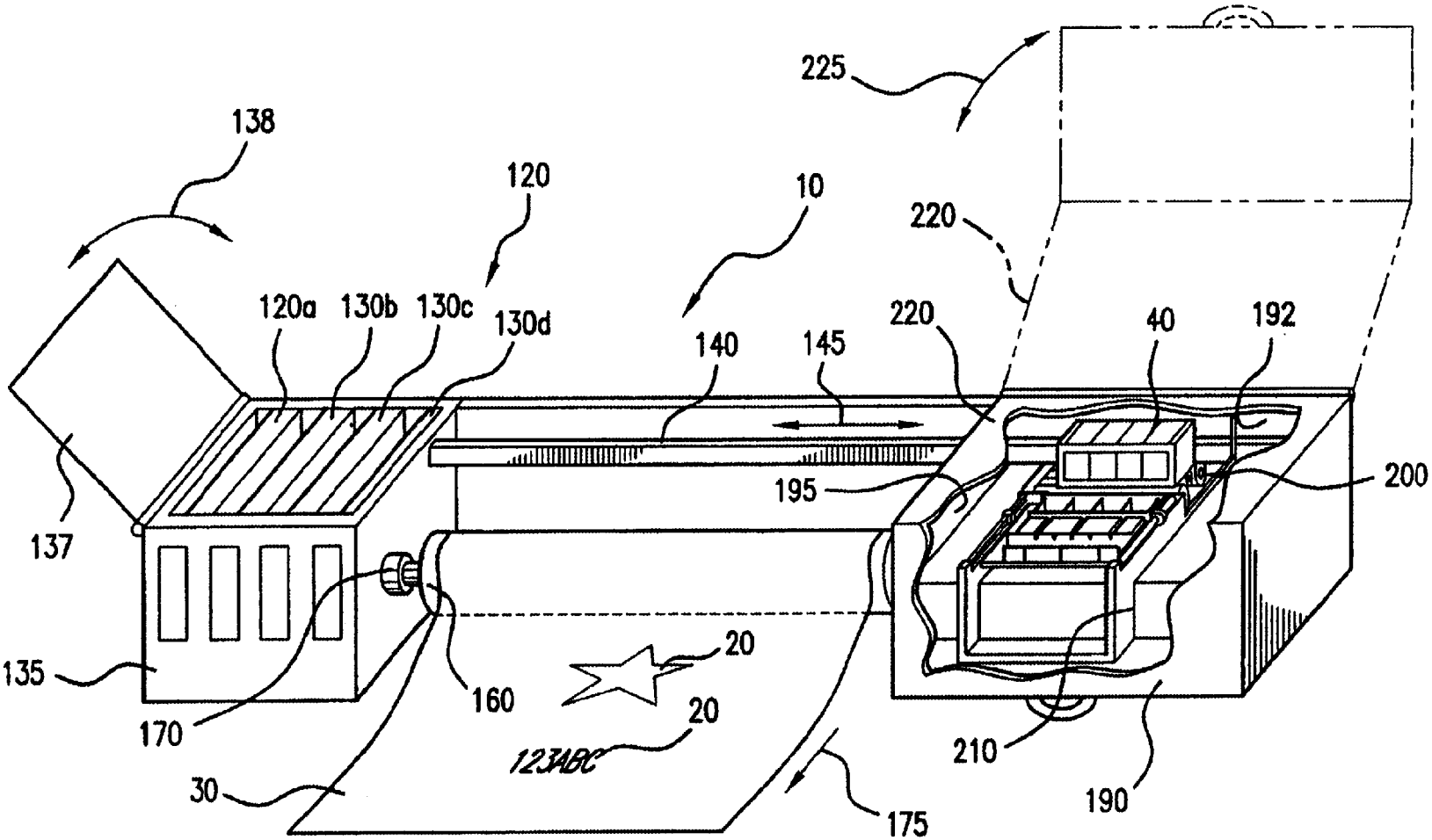
FIG. 1 is a perspective view of an inkjet printer having a print head and also a cleaning apparatus disposed therein for cleaning the print head.

Therefore, referring to FIG. 1, there is shown an inkjet printer, generally referred to as 10, for printing an image 20 on a recording medium 30. The recording medium 30 may be a reflective recording medium, such as paper, textile, or the like or recording medium 30 may be a transmissive recording medium such as transparency.

Figure 2:
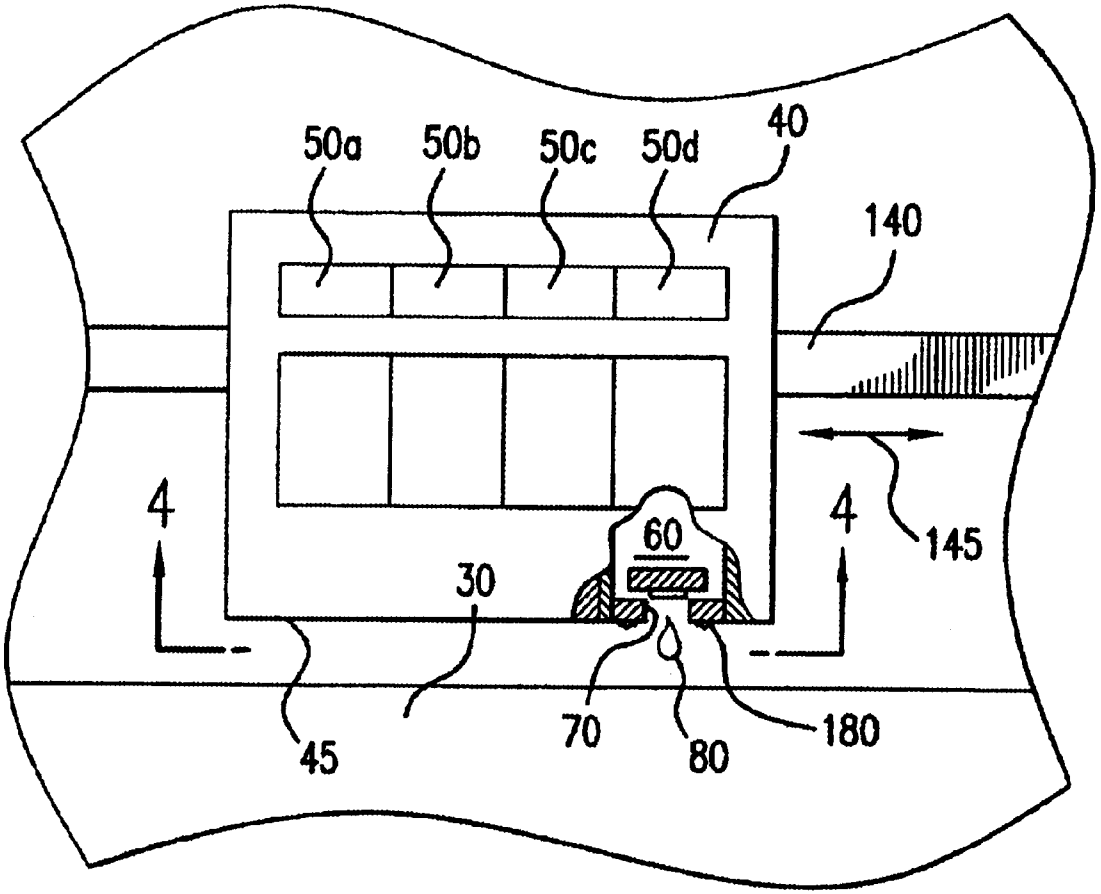
FIG. 2 is a view in partial elevation of the print head ejecting an ink drop and having particulate debris residing on an exterior surface of the print head.
Figure 3:
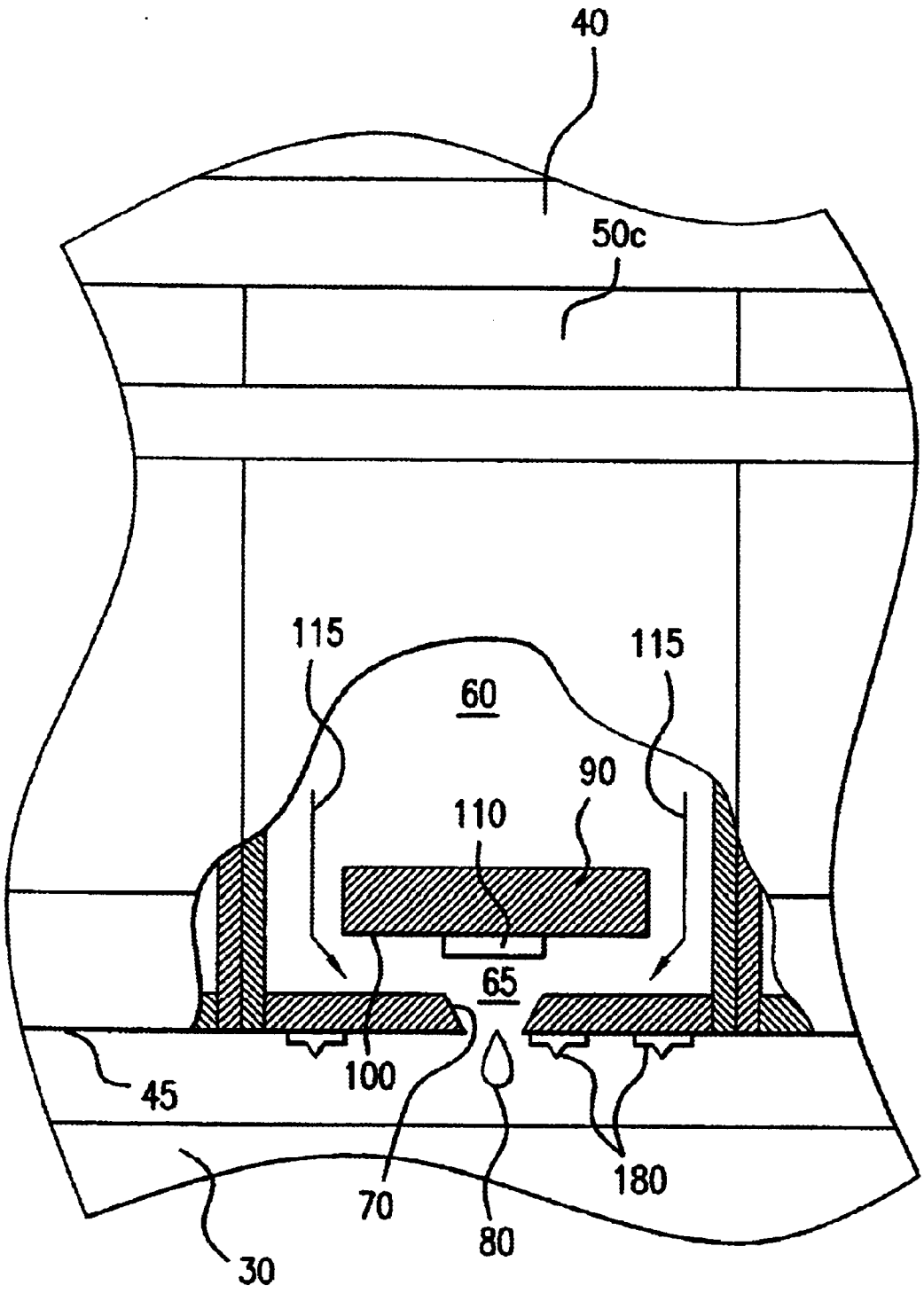
FIG. 3 is a fragmentary view in partial elevation of one of a plurality of ink cartridges belonging to the print head.

Referring to FIGS. 1, 2 and 3, printer 10 comprises a thermal ink jet print head 40 having an exterior surface 45 thereon. Print head 40 includes a plurality of adjacent ink cartridges 50*a*, 50*b*, 50*c* and 50*d* containing ink having colors cyan, magenta, yellow and black, respectively. Although four ink cartridges 50*a*, 50*b*, 50*c* and 50*d* are disclosed herein, it should be appreciated that more or fewer ink cartridges may be present depending on the specific printing application required. Each ink cartridge 50*a*/*b*/*c*/*d* has formed therein at least one ink ejection chamber 60, the chamber 60 containing an ink body 65. Ink ejection chamber 60 terminates in a plurality of collinearly-aligned ink ejection orifices 70 (only some of which are shown) for ejecting a plurality of ink drops 80 onto recording medium 30 in order to form image 20 on recording medium 30. Horizontally-disposed in chamber 60 is a generally rectangular die 90. Die 90 has an underside surface 100 for reasons disclosed presently. In this regard, attached to underside surface 100 of die 90 is a plurality of thermal resistive heater elements or thin-film resistors 110 aligned with respective ones of orifices 70, for locally boiling ink body 65 in the vicinity of orifices 70. Resistors 110 are each electrically connected to a controller (not shown), so that the controller selectively controls flow of electrical energy to resistors 110 in response to output signals received from an image source, such as a scanner, computer or digital camera (all not shown). In this regard, when electrical energy momentarily flows to any of resistors 110, the resistor 110 locally heats ink body 65 causing a vapor bubble (not shown) to form adjacent to resistor 110. The vapor bubble pressurizes chamber 60 by displacing ink body 65 to squeeze ink drop 80 from ink body 65. Ink drop 80 travels through orifice 70 to be intercepted by recording medium 30. After a predetermined time, the controller ceases supplying electrical energy to resistor 110. The vapor bubble will thereafter collapse due to absence of energy input to ink body 65 and ink will subsequently refill chamber 60 generally along flow lines illustrated by dual arrows 115. A bulk ink supply, generally referred to as 120, may be provided for supplying ink to refill chambers 60. Of course, such a bulk ink supply 120 has a plurality of ink reservoirs 130*a*, 130*b*, 130*c* and 130*d* containing ink of colors cyan, magenta, yellow and black, respectively. Each of reservoirs 130*a*/*b*/*c*/*d* is connected, such as by means of flexible hoses (not shown), to respective ones of cartridges 50*a*/*b*/*c*/*d* for refilling chambers 60 in cartridges 50*a*/*b*/*c*/*d*. Reservoirs 130*a*/*b*/*c*/*d* may reside in a housing 135 having a lid 137 capable of being rotated, such as in direction of double headed arrow 138, for opening and closing housing 135. Thermal print head 40 may preferably be of a type such as disclosed by U.S. Pat. No. 6,231,168 titled "Ink Jet Print Head With Flow Control Manifold Shape" issued May 15, 2001 in the name of Robert C. Maze and assigned to the assignee of the present invention, the disclosure of which is hereby incorporated by reference. Although print head 40 is disclosed hereinabove as a thermal print head, print head 40 alternatively may be a piezoelectric print head, if desired.

Figure 4:
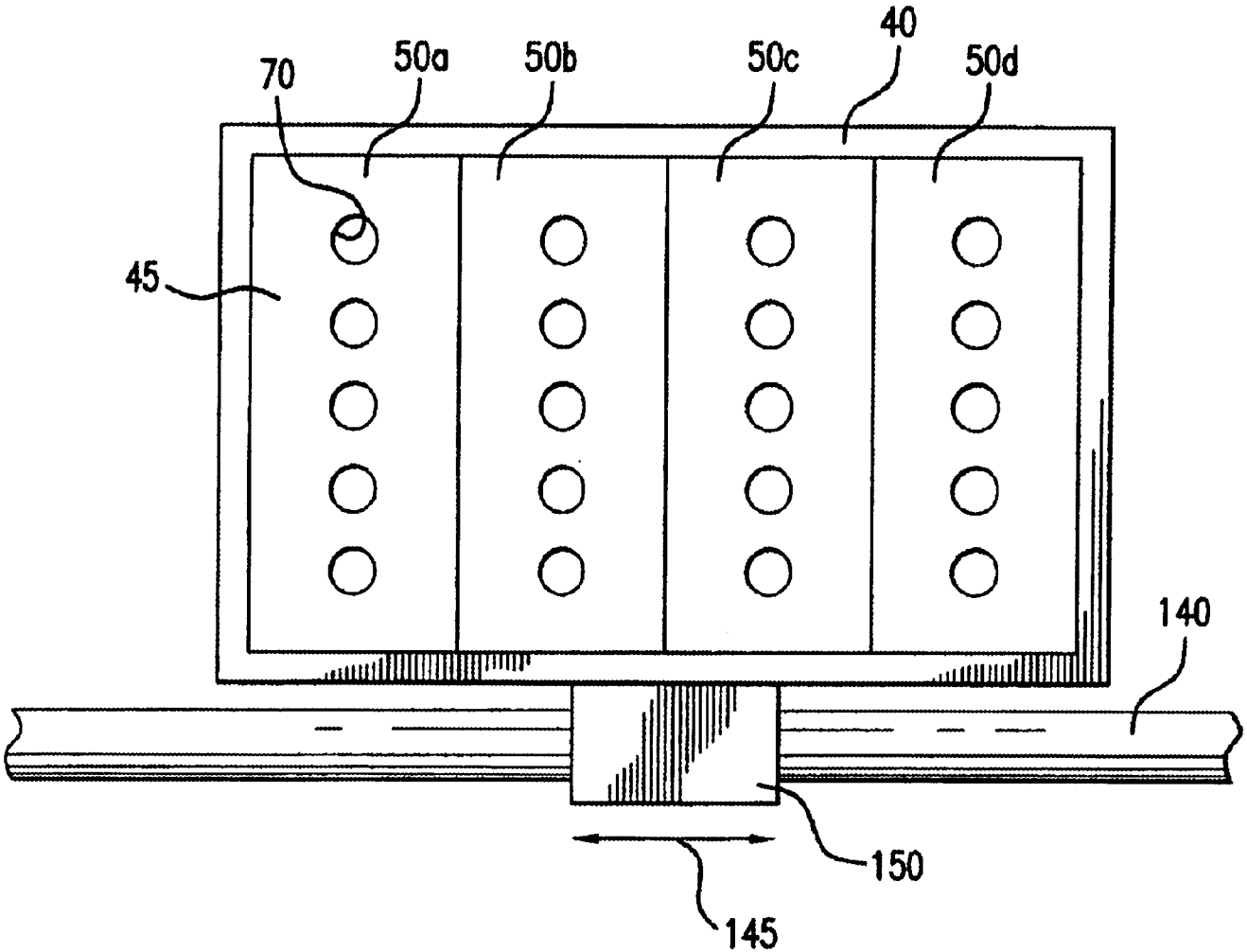
FIG. 4 is a view taken along section line 4—4 of FIG. 2.

As best seen in FIGS. 1 and 4, print head 40 is slidably mounted on a rail 140 extending at least the width of recording medium 30, so that print head 40 reciprocatingly traverses rail 140 in direction of double-headed arrow 145. Print head 40 traverses rail 140 by means of a first motor 150 connected to print head 40 and engaging rail 140. Although print head 40 is shown as being driven by first motor 150 connected to print head 40 and engaging rail 140, it may be appreciated that print head 40 may instead be driven by a belt and pulley assembly (not shown), if desired. A support member, such as a platen 160, is spaced-apart from and disposed opposite to print head 40 for supporting recording medium 30. Platen 110 may be configured as an elongate cylindrical roller operable by a second motor 170 for rotating platen 160, so that recording medium 30 moves in direction of an arrow 175.

It may be understood from the description hereinabove, that print head 40 is caused to traverse rail 140 in a first printing direction to print a first one of a plurality of printing swaths that will form image 20. As the first printing swath is printed, platen 160 is not rotated so that platen 160 remains stationary. Then, after the first swath is printed, platen 160 is rotated through a predetermined angle to advance recording medium 30 a predetermined distance in direction of arrow 175. At that point, print head 40 is caused to traverse rail 140 in a second printing direction opposite the first printing direction to print a second one of the printing swaths. In other words, print head 40 reciprocatingly traverses rail 140 in direction of arrow 145. Platen 160 is rotated only after print head 40 reaches an end portion of rail 140 during each reciprocating motion of print head 40. This process of reciprocating print head 40 and rotating platen 160 is repeated until all printing swaths are printed and recording medium 30 receives the entire desired image 20.

However, at best seen in FIGS. 2 and 3, ink can builds-up and form unwanted ink incrustations or deposits 180 on print head surface 45 and the electrical interconnect (not shown) of print head 40. These ink deposits 180 can result from the following three main sources: (1) ink puddling and splatter; (2) ink aerosol condensation on surface 45; and (3) ink redeposited on surface 45 by a service station cap and wiper. Such ink deposits 180 may lead to the following undesirable results: (1) wet ink shorting the print head electrical interconnect thereby causing electrical malfunction of print head 40; (2) paper fiber tracks causing unwanted lines of ink on recording medium 30 due to dragging of wet paper fibers stuck to ink on surface 45; (3) poor ink ejection orifice performance causing drop ejection errors, drop velocity or drop volume degradation; and (4) ink drops falling-off surface 45 causing unwanted ink spots on recording medium 30.

In addition, ink cartridges 50*a*/*b*/*c*/*d* are exposed to many kinds of air born particulate debris, such as dust, dirt and the previously mentioned paper fibers. Such particulate debris may accumulate to form particulate deposits 180 on surface 45 surrounding orifices 70 and may ultimately accumulate in orifices 70 and chambers 60 themselves. That is, such particulate deposits 180 may accumulate to form an interference burr that blocks orifice 70 or that alters surface wetting to inhibit proper formation of ink droplet 80. Blocking orifice 70 interferes with proper ejection of ink droplets 80, thereby altering the flight path of the ink droplets 80 and causing the ink droplets 80 to strike recording medium 30 in unintended locations. The particulate and ink build-up deposits 180 should be cleaned from surface 45 and orifice 70 to restore proper droplet formation and proper ink droplet trajectory.

Returning to FIG. 1, printer 10 further comprises an integrally attached open cradle 190 for removably receiving a print head cleaning apparatus, generally referred to as 200. Cradle 190 has a rear wall 192. Cradle 190 also has an opening 195 to allow print head 40 to travel along rail 140 and into cradle 190 so that print head 40 can be cleaned by cleaning apparatus 200. Opening 195 also allows print head 40 to travel along rail 140 and out of cradle 190 after cleaning by cleaning apparatus 200. As described in more detail hereinbelow, cleaning apparatus 200 is capable of cleaning particulate deposits 180 from surface 45 of print head 40. Cradle 200 may include a positioning recess 210 formed in cradle 190 for precisely slidably positioning cleaning apparatus 200 in cradle 190. Cradle 190 may also include a cover 220 capable of being rotated, such as in direction of a double-headed arrow 225, for opening and closing cradle 190 in order to protect the interior of cradle 190 from dirt, dust and the like.

Figure 5:
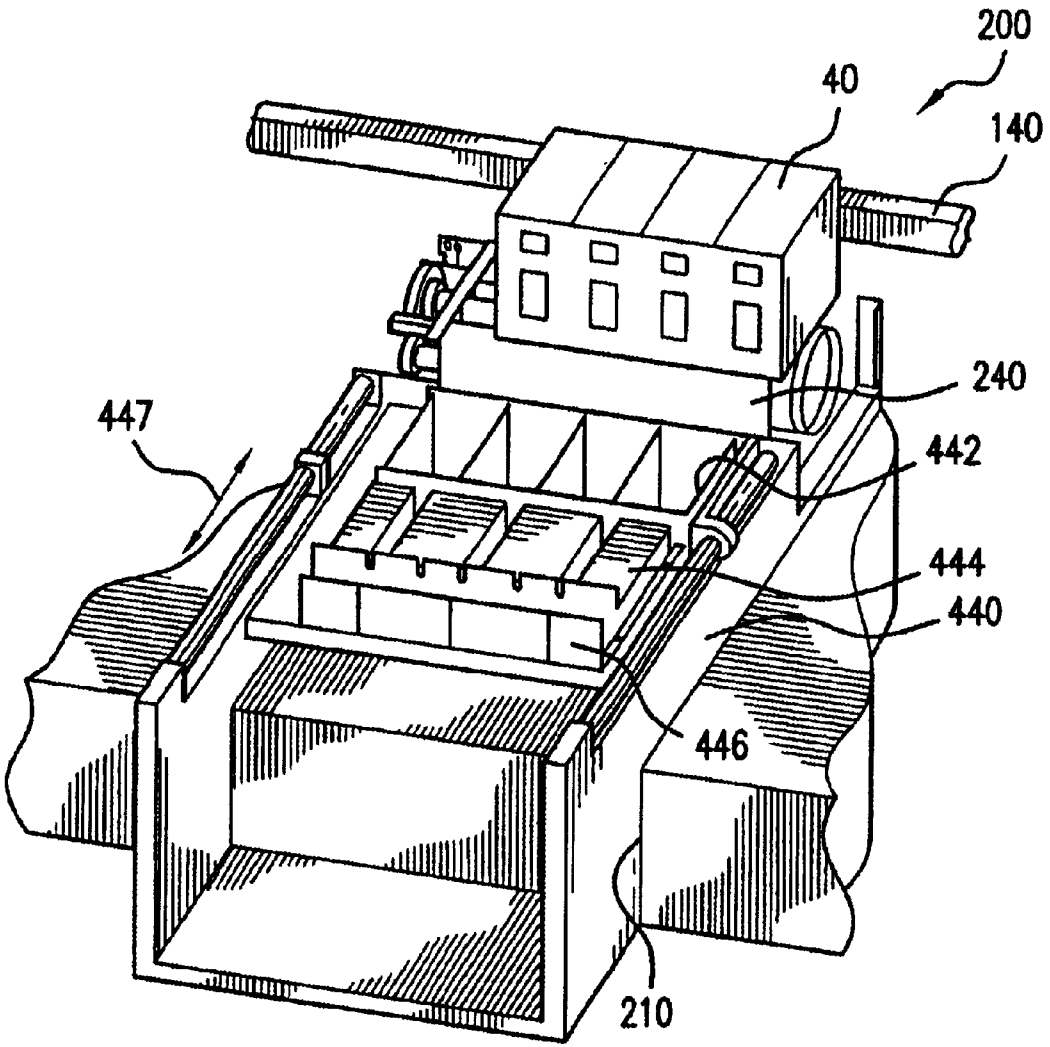
FIG. 5 is a view in perspective of a web belonging to the cleaning apparatus combined with conventional ink spittoons and print head capping stations.
Figure 6:
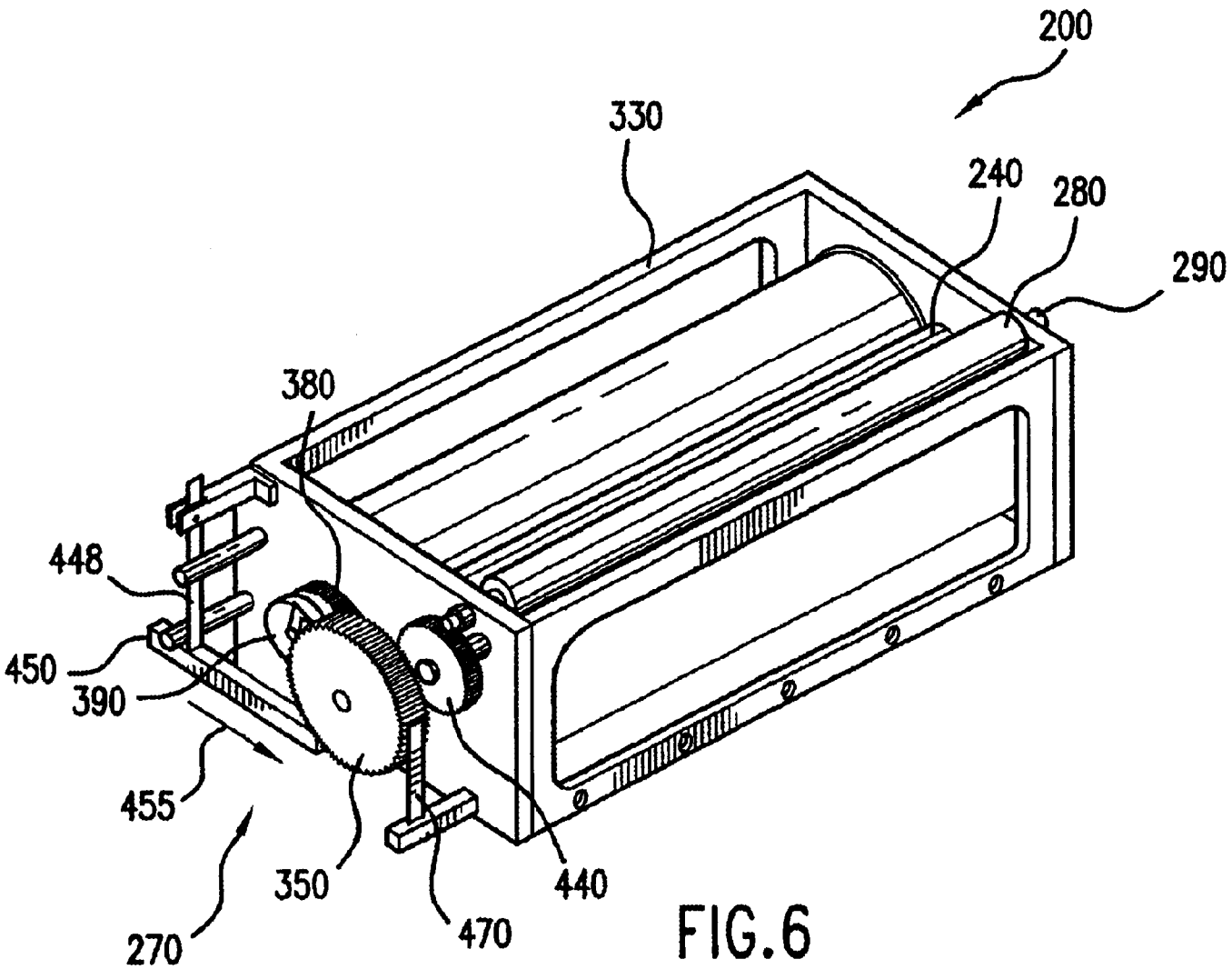
FIG. 6 is a view in perspective of the cleaning apparatus.
Figure 7:
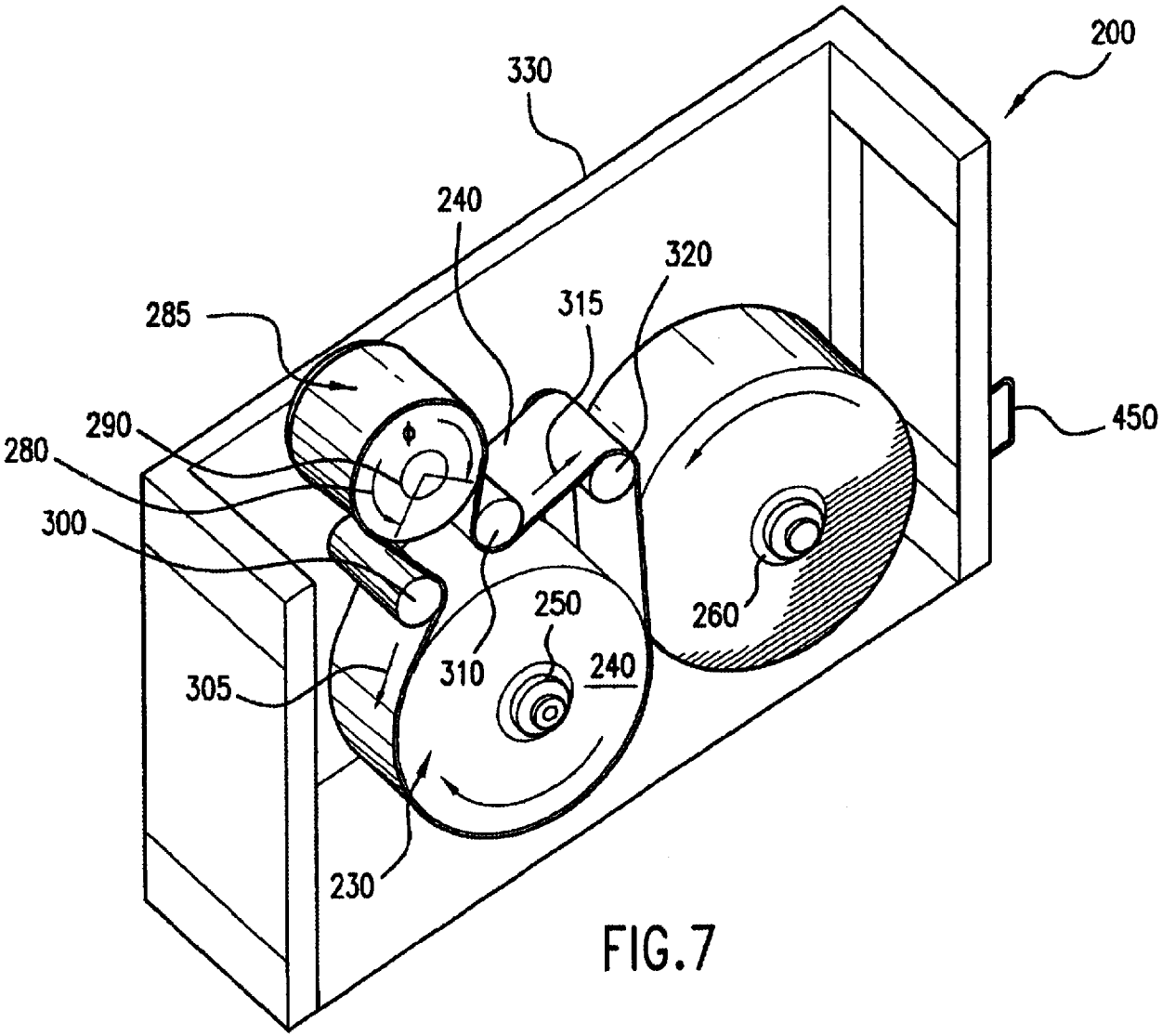
FIG. 7 is a perspective view in elevation of the cleaning apparatus, this view showing a web supply, a web receiver and a web drive roller.

Referring to FIGS. 5, 6 and 7, cleaning apparatus 200 comprises a web supply, generally referred to as 230, for supplying a cleaning web 240 therefrom. Material comprising web 240 should preferably have a low tendency to produce errant fibers in order to reduce risk that web 240 will itself deposit fibers on surface 45 of print head 40. In this regard, material comprising web 240 may be Freudenberg Evolon 100™ having a thickness of approximately 0.32 mm, or Contac EXNW0039™ having a thickness of approximately 0.23 mm, or similar web material, available from Freudenberg Vliesstoffe KG located in Weinheim, Germany. The supply of web 240 is wound about a freely rotatable first spindle 250, which may have a diameter of approximately 0.348 inch (8.84 mm). Disposed proximate first spindle 250 is a web receiver comprising a rotatable second spindle 260, which may have a diameter of approximately 0.350 inch (8.89 mm), for receiving web 240 thereon. Web 240 is capable of extending from first spindle 250 to second spindle 260 and is also capable of slidably engaging exterior surface 45 of print head 40 for cleaning surface 45 in a manner disclosed more fully hereinbelow.

Referring to FIGS. 6, 7, 8 and 9, cleaning apparatus 200 further comprises a web drive, generally referred to as 270. The web drive 270 is coupled to second spindle 260 (web receiver) for driving web 240 from first spindle 250 (web supply) to second spindle 260. Web drive 270 comprises a rotatable cylindrical drive roller 280 concentrically mounted on a third spindle 290 disposed proximate first spindle 250. Drive roller 280 may have a wall thickness of approximately 0.157 inch (4 mm). The material of drive roller 280 may be a foam that is soft enough to conform to surface 45 for providing good wiping performance, yet stiff enough to effectively drive web 240 without slippage. Drive roller 280 is adapted to engage web 240 that is supplied from first spindle 250 such that drive roller 280 pulls web 240 from first spindle 250 in the manner disdosed hereinbelow. Web 240 is caused to wrap partially around drive roller 280, as shown. That is, web 240 partially wraps around drive roller 280 so as to define a predetermined "wrap angle" Ø. The amount or value of wrap angle Ø is predetermined such that wrap angle Ø ensures that friction between web 240 and drive roller is sufficient to move web 240 as drive roller 280 rotates. In this manner, a "passive slip clutch" arrangement generally referred to as 285 is provided as web 240 partially wraps around drive roller 280 to define wrap angle Ø. That is, passive slip clutch arrangement 285 is provided by roller 280 and web 240 as web 240 partially wraps around drive roller 280 to define wrap angle Ø. Moreover, to maintain wrap angle Ø, interposed between web supply 230 and drive roller 280 and engaging web 240 is a generally cylindrical first tensioning bar 300. First tensioning bar 300 assists in applying a back tension force to a portion of web 240 residing between drive roller 280 and web supply 230. The back tension force acts in a direction 305 away from drive roller and toward web supply 230. In addition, disposed opposite first tensioning bar 300 and interposed between drive roller 280 and second spindle 260 and engaging web 240 is a generally cylindrical second tensioning bar 310. Second tensioning bar 310 assists in applying a forward tension force to a portion of web 240 residing between drive roller 280 and second spindle 260. Furthermore, disposed approximately intemediate first spindle 250 and second spindle 260 is a generally cylindrical third tensioning bar 320 to also assist in applying a forward tension force to the portion of web 240 residing between drive roller 280 and second spindle 260. The forward tension force acts in a direction 315 away from drive roller 280 and toward second spindle 260. Thus, it may be understood from the description hereinabove and with reference to the several figures that web 240 defines a web path extending from web supply 230 to under first tensioning bar 300, to over drive roller 280, to under second tensioning bar 310, to over third tensioning bar 320 and then onto second spindle 260. In addition, first spindle 250, second spindle 260, third spindle 290, first tensioning bar 300, second tensioning bar 310 and third tensioning bar 320 are each coupled to a lightweight frame 330 made of plastic, aluminum, or the like, for supporting these components. Moreover, as described more fully hereinbelow, the portion of web 240 wrapped partially around drive roller 280 will engage print head surface 45 for cleaning print head surface 45.

Referring again to FIGS. 6, 7, 8 and 9, the transverse cross section of drive roller 280 is illustrated as being circular. However, drive roller 280 may have a noncircular transverse cross section, such as oval, triangular or square, if desired. Moreover, corners of such a noncircular cross section for drive roller 280 could be presented to surface 45 in a manner to provide a "sharper" edge of drive roller 280 in order to enhance cleaning of surface 45.

Referring yet again to FIGS. 6, 7, 8 and 9, web drive 270 further comprises a gear train, generally referred to as 340. The gear train 340 is coupled to second spindle 260 (web receiver) and third spindle 290 (drive roller 280) for controllably rotating second spindle 260 and third spindle 290. Gear train 340 will now be described in detail. In this regard, gear train 340 comprises a firs gear 350 supported by first spindle 250 of web supply 240. Although first gear 350 is supported by first spindle 250, first gear 350 does not rotate first spindle 250. Rather, first spindle 250 is freely rotatable. In other words, first gear 350 is freely rotatable. First gear 350 may have a diameter of approximately 1.000 inch (25.4 mm). Coupled to first gear 350 is a second gear 360, which may have a diameter of approximately 0.833 inch (21.2 mm). Also coupled to first gear is a third gear 370, which may have a diameter of approximately 0.833 inch (21.2 mm). Connected to second spindle 260 and engaging second gear 360 is a fourth gear 380, which may have a diameter of approximately 0.563 inch (14.3 mm), so that fourth gear 380 rotates while second gear 360 rotates. Of course, second spindle 260 rotates while fourth gear 380 rotates in order to take-up web 240 onto second spindle 260. Slidably coupled to second spindle 260 and affixed to fourth gear 380 is an adjustable overdrive slip clutch 390. Overdrive slip clutch 390 has a threaded hole 395 therethrough in communication with a slot 397 formed in overdrive slip clutch 390. The purpose of hole 395 is to receive a screw (not shown) for adjustably tightening and loosening overdrive slip clutch 390 on second spindle 260. That is, tightening the screw will tend to close slot 397 thereby forcing clutch 390 to radially constrict and tighten around second spindle 260. Conversely, loosening the screw will tend to open slot 397 allowing clutch 390 to radially expand and loosen around second spindle 260. Thus, overdrive slip clutch 390 is adjustable for applying a predetermined amount of sliding friction to second spindle 260. In this manner, overdrive slip clutch 390 can be adjusted so as to apply a desired forward tension force acting on web 240 in a direction generally illustrated by arrow 315.

Still referring to FIGS. 6, 7, 8 and 9, gear train 340 also comprises a fifth gear 400, which may have a diameter of approximately 0.563 inch (14.3 mm). Fifth gear 400 engages third gear 370, so that fifth gear 400 rotates while third gear 370 rotates. Coupled to fifth gear 400 is a sixth gear 410, which may have a diameter of approximately 0.188 inch (4.76 mm). Engaging sixth gear 410 and connected to third spindle 290 (drive roller 280) is a seventh gear 420, which may have a diameter of approximately 0.188 inch (4.76 mm), so that seventh gear 420 rotates while sixth gear 410 rotates. Of course, third spindle 290 rotates while seventh gear 420 rotates in order to rotate drive roller 280. Adjustment of overdrive slip clutch 390 and presence of the previously mentioned passive slip clutch (i.e., provided by drive roller 280 and web 240 as web 240 partially wraps around drive roller 280 to define wrap angle Ø) allow overdrive slip clutch 390 and the passive slip clutch to cooperatively act to produce the previously mentioned back tension force and forward tension force. Proper management of the back tension force and the forward tension force will hold web 240 in tension. In this manner, web 240 remains in tension and wrinkle-free. It is important that web 240 remains wrinkle-free. This is important because wrinkle-free web 240 ensures that web 240 will contact surface 45 of print head 40 without gaps in contact coverage. This enhances cleaning effectiveness compared to a web having wrinkles.

Returning to FIGS. 1 and 5, cleaning apparatus 200 further includes a chassis 440 integrally connected to frame 330 for reasons disclosed presently. In this regard, chassis 440 includes a plurality of conventional spittoons 442 alignable with ink ejection orifices 70 of cartridges 50*a/b/c/d* for receiving ink ejected or "spit" from cartridges 50*a/b/c/d*. This occasional "spitting" of ink from orifices 70 of cartridges 50*a/b/c/d* is intended to keep orifices 70 clear of unwanted dried ink and particulate debris. Chassis 440 further includes a plurality of conventional capping stations 444 alignable with orifices 70 for capping orifices 70 when print head 40 is not in use. Capping of orifices 70 reduces risk that ink will dry-out. Moreover, chassis 440 also includes a plurality of barrier walls 446 capable of abutment with respective ones of cartridges 50*a/b/c/d* to establish a barrier against damage to cartridges 50*a/b/c/d* while cartridges 50*a/b/c/d* are capped. Chassis 440 and integrally attached frame 330 are movable generally in the direction of a double-headed arrow 447 for aligning spittoons 442 or capping stations 444 with orifices 70 of cartridges 50*a/b/c/d*. Chassis 440 and integrally attached frame 330 are movable by means of a motor mechanism (not shown) engaging chassis 440. Thus, web 240 of cleaning apparatus 200 is inventively combined with traditional spittoons 442 and capping stations 444 for enhanced cleaning effectiveness.

Still referring to FIGS. 1 and 5, the cleaning technique using cleaning apparatus 200 will now be described. In this regard, first motor 150, which engages rail 140 and print head 40, moves print head 40 along rail 140, through opening 195 and into cradle 190 to begin the cleaning event. First motor 150 positions print head 40 at a predetermined location within cradle 190, such that surface 45 can be cleaned by web 240. The previously mentioned motor mechanism (not shown) that engages chassis 440 then reciprocates chassis 440 backward and forward along positioning recess 210 in direction of arrow 447. Reciprocation of chassis 440 backward and forward a single time is defined herein as a cleaning cycle. When chassis 440 translates in the forward direction (i.e., toward the front of printer 10), the portion of web 240 that is partially wrapped around drive roller 280 will engage surface 45 of print head 40 to clean surface 45. When chassis 440 translates in the backward direction (i.e., toward the rear of printer 10), the portion of web 240 that is partially wrapped around drive roller 280 will again engage surface 45 of print head 40 to clean surface 45. This movement of chassis 440 will cause web 240 to rub surface 45 and remove particulate debris 180 from surface 45 in order to clean surface 45. The particulate debris 180, thus removed, will adhere to web 240 due to the composition of web 240, which may be the previously mentioned Freudenberg Evolon 100™ or Contac EXNW0039™. Approximately seven cleaning cycles are preferably used to clean surface 45. However, at the end of each cleaning cycle, first motor 150 that engages print head 40 and rail 140 moves print head 40 through opening 195 and out cradle 190 in order to continue printing image 20. This process is repeated until all cleaning cycles (e.g., seven cleaning cycles) comprising the cleaning event are completed. After a predetermined time during operation of printer 10, print head 40 is again cleaned in the manner described immediately hereinabove. However, between each cleaning event, web 240 is advanced in the manner disclosed hereinbelow. Advancement of web 240 presents a clean and unused portion of web 240 for cleaning print head 40 prior to each cleaning event.

Figure 8:
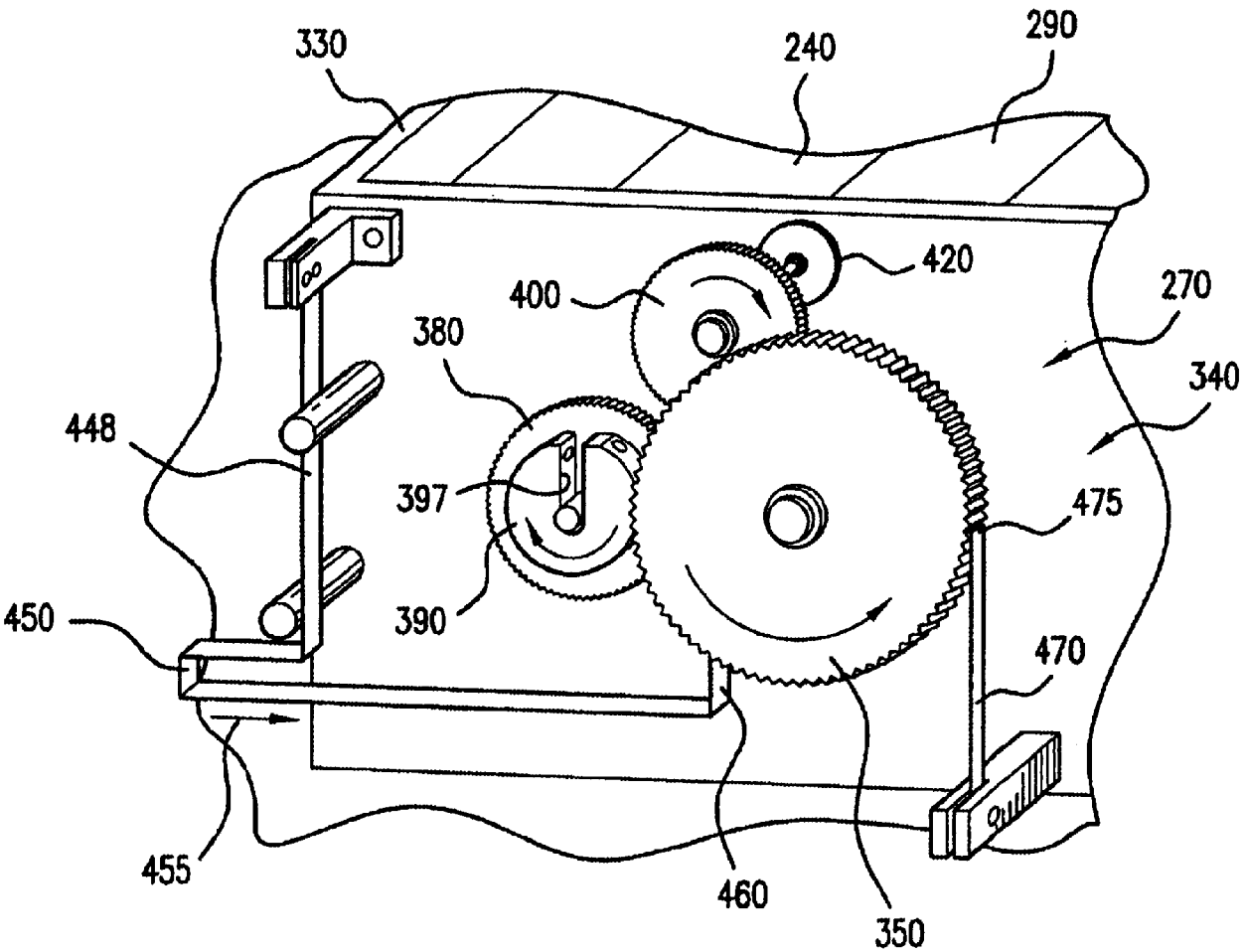
FIG. 8 is a perspective view in elevation of the cleaning apparatus, this view showing a first gear belonging to a gear train and also showing an actuator and ratchet engaging the first gear.
Figure 9:
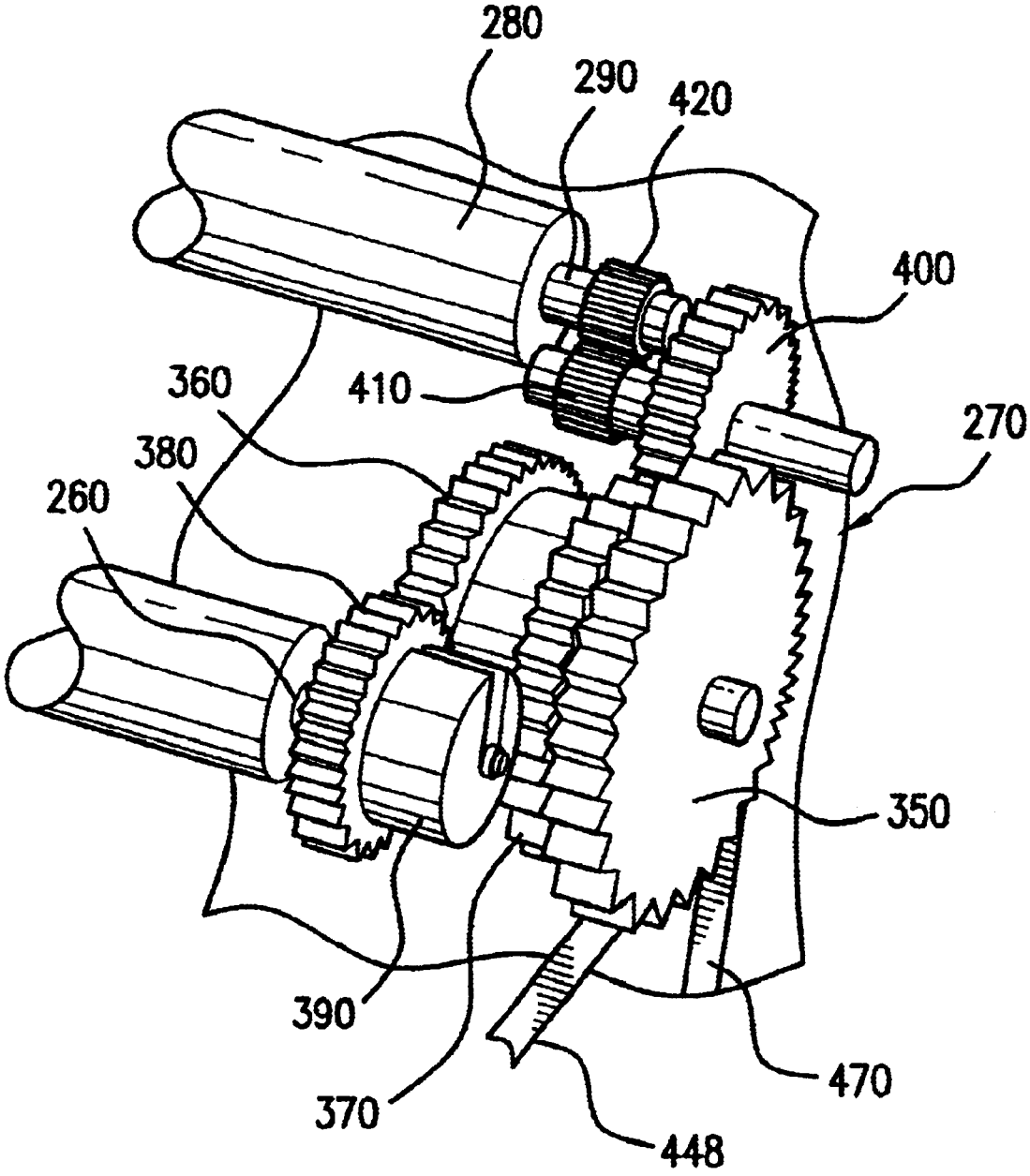
FIG. 9 is a view in perspective of the gear train, with parts removed for clarity.

The manner in which web 240 is advanced will now be described. As best seen in FIGS. 1 and 8, cleaning apparatus 200 further comprises an elastic lever or actuator 448 connected to frame 330 and adapted to engage rear wall 192 for indexing first gear 350 a predetermined amount. When first gear 330 is indexed, second spindle 260 and drive roller 280 each index a predetermined amount proportional to their respective diameters. Second spindle 260 and drive roller 280 will index when first gear 330 is indexed because first gear 330 is coupled to second spindle 260 and drive roller 280 in the manner previously described. In this regard, actuator 440, which may be a relatively thin member of stainless steel, has an outwardly projecting elbow-shaped portion 450 for engagement with rear wall 192 in a manner described more fully hereinbelow. In this respect, when the previously mentioned motor mechanism (not shown) reciprocates chassis 440 after the last cleaning cycle (e.g., the seventh cleaning cycle), the motor mechanism will move chassis 440 toward rear wall 192 until elbow-shaped portion 450 engages rear wall 192. When elbow-shaped portion 450 engages rear wall 192, actuator 440 will elastically move generally in a direction illustrated by arrow 455. When actuator 440 moves in the direction illustrated by arrow 455, an end portion 460 of actuator 440 will engage first gear 350 to index first gear 350 the predetermined amount. Indexing of first gear 350 will also index gears 360, 370, 380, 400, 410 and 420 because first gear 350 and gears 360, 370, 380, 400, 410 and 420 are all interacting members of gear train 340. Of course, indexing of first gear 350 and gears 360, 370, 380, 400, 410 and 420 will index drive roller 280, second spindle 260 and third spindle 290 for advancing web 240 a predetermined amount. As previously mentioned, advancement of web 240 presents a clean and unused portion of web 240 for cleaning print head 40 prior to a cleaning event. After first gear 350 is indexed, the controller (not shown) controlling the motor mechanism will translate chassis 440 away from rear wall 192, so that elbow-shaped portion 450 of actuator 440 disengages rear wall 192. Due to the elastic nature of actuator 440, the actuator 440 will then reset or return to its original position, to await the next cleaning event.

Still referring to FIG. 8, it is desirable to prevent first gear 350 from reversing direction, such as due to vibration, after being indexed. This is desirable in order to prevent reverse travel of web 240 and redeposit of the particulate debris 180 onto surface 45 by web 240. Therefore, an elongate ratchet lock 470 is also provided to prevent first gear 350 from reversing direction after being indexed. Ratchet lock 470 is connected to frame 330 and has an end portion 475 adapted to engage first gear 350. Ratchet lock 470 allows first gear 350 to index in its intended direction but not to reverse direction after being indexed.

It may be understood from the description hereinabove that first spindle 250 will obtain a predetermined amount of lineal travel ? $S_f$ which is equal to the radius of first gear 350 times the angle of rotation of first gear 350 when first gear 350 is indexed by actuator 440. A predetermined amount of web 240 will be fed from web supply 230 each time first gear 350 is indexed by actuator 440. For example, indexing of first gear 350 one time, which corresponds to approximately 0.0524 inch (1.33 mm) of travel of actuator 440, may equal 30° of rotation of first gear 350. This, in turn, may correspond to approximately 0.0269 inch (0.685 mm) of travel for web 240. Also, according to the invention, the rate at which web 240 is taken-up by second spindle 260 is faster than the rate of web 240 that is fed from web supply 230. This is so in order to maintain tension in web 240 without slack, so that web 240 is wrinkle-free. In other words, $?S_E > ?S_I$, or $(?S_E)/(?S_I) > 1$, where $?S_E$ equals the radius of fourth gear 380 times the angle of rotation of fourth gear 380 when fourth gear 380 is indexed. It may be appreciated by a person of ordinary skill in the art that second spindle 260 is coupled to fourth gear 380 and therefore $?S_E$ increases as web 240 is wound onto second spindle 260.

Figure 10:
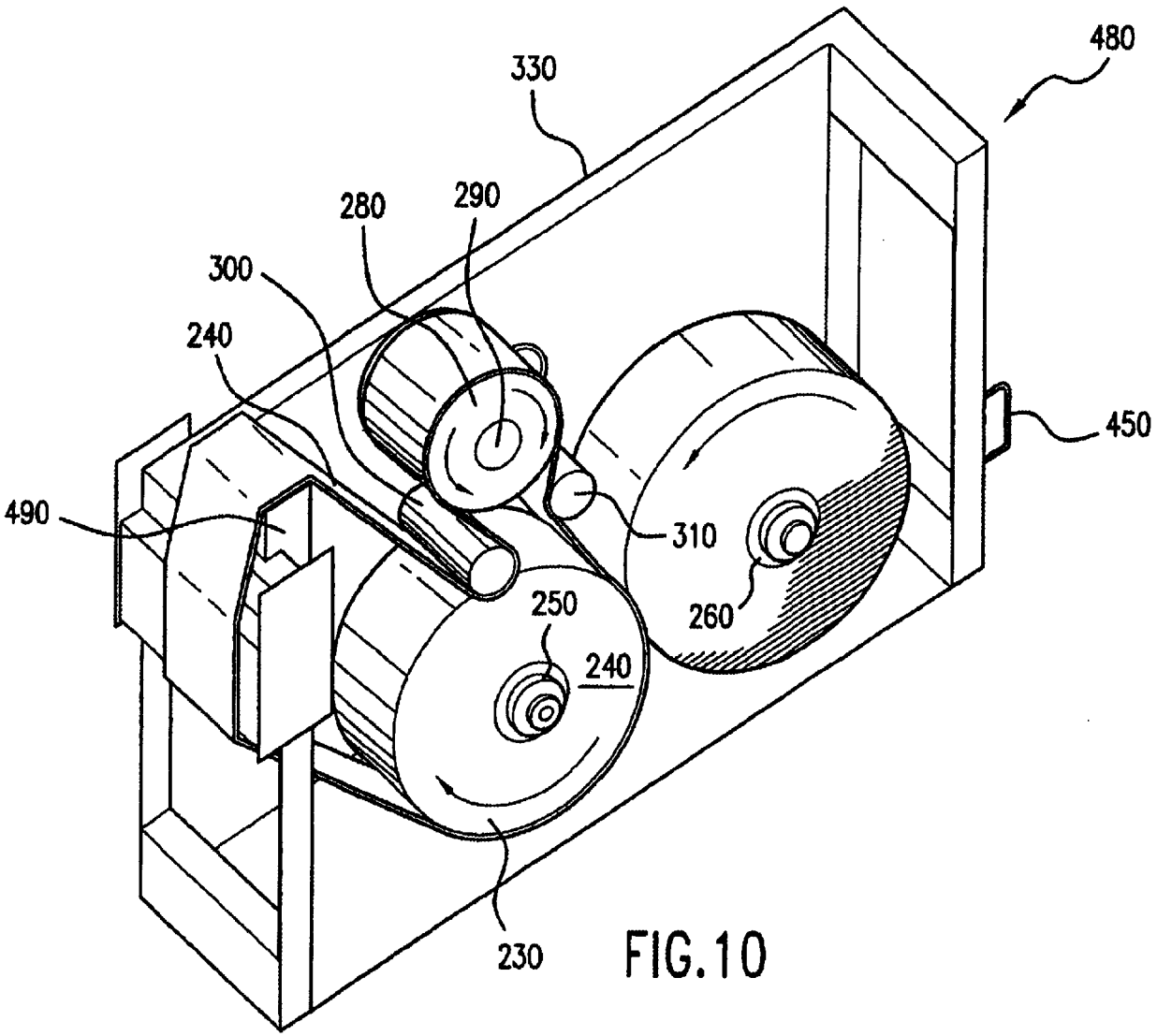
FIG. 10 is a view in perspective of a second embodiment cleaning apparatus.
Figure 11:
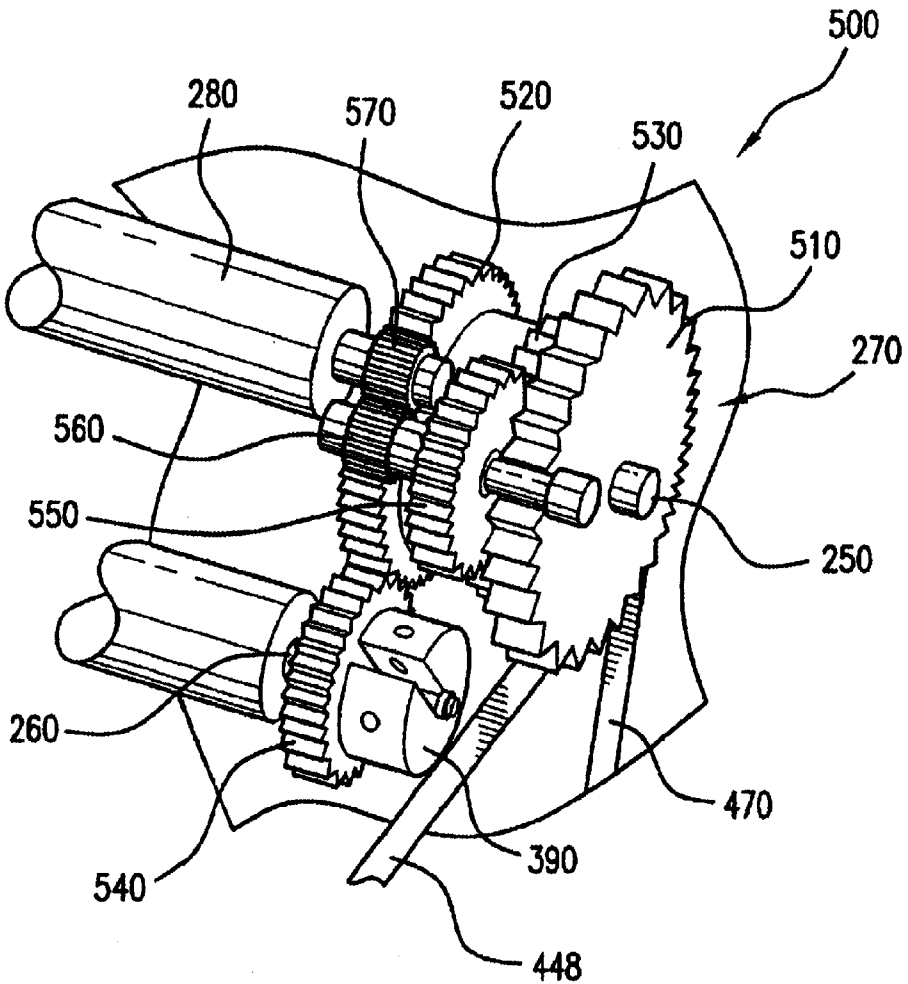
FIG. 11 is a view in perspective of a second embodiment gear train, with parts removed for clarity, that belongs to the second embodiment cleaning apparatus.

Turning now to FIGS. 10 and 11, there is shown a second embodiment of the present invention, which is a second embodiment cleaning apparatus generally referred to as 480. Second embodiment cleaning apparatus 480 is substantially similar to first embodiment cleaning apparatus 200, except that a pressure foot 490 of predetermined transverse cross section is connected to frame 330 and interposed between web supply 230 and drive roller 280. Material of pressure foot 490 may be a foam that is soft enough to conform to surface 45 for providing good wiping performance. Use of second embodiment cleaning apparatus 480 obtains an advantage not provided by first embodiment cleaning apparatus 200. In this regard, cross section of pressure foot 490 may possess virtually any desired cross sectional profile. This in turn provides greater flexibility in designing the interactions between web 240 and surface 45 of print head 40 compared to the circular cross section of drive roller 280 when only drive roller 280 is used to clean surface 45 of print head 40.

Referring again to FIGS. 10 and 11, cleaning apparatus 480 may also comprise a second embodiment gear train, generally referred to as 500. The gear train 500 is coupled to first spindle 250 (web supply 230), second spindle 260 (web receiver) and third spindle 290 (drive roller 280) for controllably rotating first spindle 250, second spindle 260 and third spindle 290 in the manner disclosed hereinbelow. In this regard, second embodiment gear train 500 will now be described in detail. More specifically, gear train 500 comprises an eighth gear 510 supported by freely rotatable first spindle 250. Eighth gear 510 may have a diameter of approximately 1.000 inch (25.4 mm). Coupled to eighth gear 510 is a ninth gear 520, which may have a diameter of approximately 0.833 inch (21.2 mm). Also coupled to eighth gear 510 is a tenth gear 530, which may have a diameter of approximately 0.667 inch (16.9 mm). Connected to second spindle 260 and engaging tenth gear 530 is an eleventh gear 540, which may have a diameter of approximately 0.563 inch (14.3 mm), so that eleventh gear 540 rotates while ninth gear rotates. Slidably coupled to second spindle 260 and affixed to eleventh gear 540 is the previously mentioned overdrive slip clutch 390 for applying a predetermined amount of sliding friction to second spindle 260.

Still referring to FIGS. 10 and 11, second embodiment gear train 500 also comprises a twelfth gear 550, which may have a diameter of approximately 0.438 inch (11.1 mm). Twelfth gear 550 engages tenth gear 530, 0 that twelfth gear 550 rotates while tenth gear 530 rotates. Coupled to twelfth gear 550 is a thirteenth gear 560, which may have a diameter of approximately 0.209 inch (5.31 mm). Engaging thirteenth gear 560 and connected to third spindle 290 is a fourteenth gear 570, which may have a diameter of approximately 0.229 inch (5.82 mm), so that fourteenth gear 570 rotates while thirteenth gear 560 rotates. Moreover, web 240 wraps partially around drive roller 280 to define the previously mentioned passive slip clutch arrangement.

It may be understood from the description hereinabove that, according to this second embodiment cleaning apparatus 480, first spindle 250 will obtain a predetermined amount of lineal travel $\Delta S_1$ which equals the radius of eighth gear 510 times the angle of rotation of eighth gear 510 when eighth gear 510 is indexed. A predetermined amount of web 240 will be fed from web supply 230 each time eighth gear 510 is indexed by actuator 440. For example, indexing of eighth gear 510 one time, which corresponds to approximately 0.0524 inch (1.33 mm) of travel of actuator 440, may equal 3° of rotation of eighth gear 510. This in turn, may correspond to approximately 0.0182 inch (0.0.462 mm) of travel for web 240. Adjustment of overdrive slip clutch 390 and presence of the previously mentioned passive slip clutch arrangement 285 (i.e., provided by drive roller 280 and web 240 as web 240 partially wraps around drive roller 280 to define wrap angle Ø) allow overdrive slip clutch 390 and the passive slip clutch arrangement to cooperatively act to hold web 240 in tension, so that web 240 remains wrinkle-free. Moreover, this second embodiment cleaning apparatus 500 includes the previously mentioned chassis 440 integrally connected to frame 330 for reasons disclosed hereinabove.

It may be appreciated from the description hereinabove, that an advantage of the present invention is that use thereof eliminates need for wipers and scrapers, yet removes ink build-up and particulate debris from the exterior surface 45 of the print head 40. This is so because the invention uses web 240 to rub surface 45 in order to clean print head 40.

Another advantage of the present invention is that use thereof thoroughly cleans surface 45 of print head 40 in order (1) to avoid wet ink shorting the electrical interconnect between the print head and controller; (2) to remove paper fiber tracks causing unwanted lines of ink on the recording medium; (3) to improve poor ink ejection orifice performance that otherwise cause drop ejection errors, drop velocity or drop volume degradation; and (4) to reduce risk of ink drops falling-off the print head causing unwanted ink spots on the recording medium. This is so because web 240 remains wrinkle-free to contact surface 45 of print head 40 without gaps in coverage in order to remove particulate debris 180 more efficiently compared to a web having wrinkles.

Yet another advantage of the present invention is that use thereof reduces cleaning time. This is so because web 240 rubs surface 45 to remove particulate debris 180 and avoids reliance on the relatively slow process of capillary action in order to clean surface 45 of print head 40 by absorption of ink. Also, use of the invention reduces cleaning time compared to using wipers because rubbing surface 45 to clean surface 45 can be accomplished more quickly than moving a flexible (e.g., rubber) wiper across surface 45. This is so because such a wiper is moved relatively slowly along surface 45 to allow time for the flexible wiper to conform to the contour (e.g., surface irregularities) of surface 45. The foam material of drive roller 280 (or foot 490), on the other hand, readily conforms to irregularities of surface 45.

While the invention has been described with particular reference to its preferred embodiments, it will be understood by those skilled in the art that various changes may be made and equivalents may be substituted for elements of the preferred embodiments without departing from the invention. For example, different configurations of gear trains other than gear train 340 and second embodiment gear train 500 may be used, if desired. As another example, although the invention is disclosed herein for cleaning a thermal inkjet print head, the invention may also be used to clean a piezoelectric inkjet print head as well.

Therefore, what is provided is a cleaning apparatus and method of assembly therefor for cleaning an inkjet print head.

Parts List

Ø. . . wrap angle
10 . . . inkjet printer
20 . . . image
30 . . . recording medium
40 . . . print head
45 . . . exterior surface
50*a*/*b*/*c*/*d* . . . ink cartridges
60 . . . ink ejection chambers
65 . . . ink body
70 . . . ink ejection orifices
80 . . . ink drop
90 . . . die
100 . . . underside surface of die
110 . . . thermal resistors
115 . . . arrow (flowlines)
120 . . . bulk ink supply
130*a*/*b*/*c*/*d* . . . ink reservoirs
135 . . . housing
137 . . . lid
138 . . . arrow (direction of rotation of lid 137)
140 . . . rail
145 . . . arrow (direction of travel of print head 40)
150 . . . first motor
160 . . . platen
170 . . . second motor
175 . . . arrow (direction of travel of recording medium 30)
180 . . . deposits
190 . . . cradle
192 . . . rear wall
195 . . . opening
200 . . . print head cleaning apparatus
210 . . . positioning recess
220 . . . cover
225 . . . arrow (direction of rotation of cover 220)
230 . . . web supply
240 . . . web
250 . . . fist spindle
260 . . . second spindle
270 . . . web drive
280 . . . drive roller
285 . . . passive slip clutch arrangement
290 . . . third spindle
300 . . . first tensioning bar
305 . . . arrow (direction of back tension force)
310 . . . second tensioning bar
315 . . . arrow (direction of forward tension force)
320 . . . third tensioning bar
330 . . . frame
340 . . . geutrain
350 . . . first gear
360 . . . second gear
370 . . . third gear
380 . . . fourth gear
390 . . . overdrive slip clutch
395 . . . threaded hole
397 . . . slot
400 . . . fifth gear
410 . . . sixth gear
420 . . . seventh gear
440 . . . chassis
442 . . . spittoons
444 . . . capping stations
446 . . . barrier walls
447 . . . arrow (direction of movement of chassis)
448 . . . actuator
450 . . . elbow-shaped portion of actuator
455 . . . arrow (direction of movement of actuator)
460 . . . end portion (of actuator)
470 . . . ratchet lock
475 . . . end portion (of ratchet lock)
480 . . . second embodiment cleaning apparatus
490 . . . pressure foot
500 . . . second embodiment gear train
510 . . . eighth gear
520 . . . ninth gear
530 . . . tenth gear
540 . . . eleventh gear
550 . . . twelfth gear
560 . . . thirteenth gear
570 . . . fourteenth gear

What is claimed is:

1. A cleaning apparatus for cleaning an inkjet print head, comprising:

a. a rotatable first spindle for supplying a web therefrom;

b. a rotatable second spindle disposed proximate said first spindle for receiving the web thereon, the web being capable of extending from said first spindle to said second spindle while slidably engaging the print head for cleaning the print head;

c. a web drive coupled to said first spindle and said second spindle for driving the web from said first spindle to said second spindle, said web drive including:

i. a rotatable drive roller disposed proximate said first spindle for engaging the web supplied from said first spindle, so that said drive roller pulls the web from said first spindle with a predetermined back-tension force; and ii. a clutch coupled to said second spindle for controlling rotation of said second spindle, so that said second spindle pulls the web onto said second spindle with a predetermined forward-tension force greater than the back-tension force, in order that the web is wrinkle-free while the web slidably engages the print head.

2. The cleaning apparatus of claim 1, wherein said web drive comprises a gear train coupled to said second spindle and said drive roller for rotating said second spindle and said drive roller.

3. The cleaning apparatus of claim 2, wherein said gear train comprises a plurality of gears coupled to respective ones of said second spindle and said drive roller.

4. The cleaning apparatus of claim 3, further comprising an actuator adapted to engage said gears for indexing said gears, so that said gears index a predetermined amount.

5. The cleaning apparatus of claim 1, further comprising a spittoon alignable with the print head and adapted to receive ink ejected from the print head.

6. The cleaning apparatus of claim 1, further comprising a capping station alignable with the print head for capping the print head.

7. A method of assembling a cleaning apparatus for cleaning an inkjet print head, comprising the steps of:

a. providing a rotatable first spindle for supplying a web therefrom;

b. disposing a rotatable second spindle proximate the first spindle for receiving the web thereon, the web being capable of extending from the first spindle to the second spindle while slidably engaging the print head for cleaning the print head;

c. coupling a web drive to the first spindle and the second spindle for driving the web from the first spindle to the second spindle, the step of coupling the web drive including the steps of:

i. disposing a rotatable drive roller proximate the first spindle for engaging the web supplied from the first spindle, so that the drive roller pulls the web from the first spindle with a predetermined back-tension force; and ii. coupling a clutch to the second spindle for controlling rotation of the second spindle, so that the second spindle pulls the web onto the second spindle with a predetermined forward-tension force to the web greater than the back-tension force, in order that the web is wrinkle-free while the web slidably engages the print head.

8. The method of claim 7, wherein the step of coupling the web drive comprises the step of coupling a gear train to the second spindle and the drive roller for rotating the second spindle and the drive roller.

9. The method of claim 8, wherein the step of coupling the gear train comprises the step of coupling a plurality of gears to respective ones of the second spindle and the drive roller.

10. The method of claim 9, further comprising the step of providing an actuator adapted to engage the gears for indexing the gears, so that the gears index a predetermined amount.

11. The apparatus of claim 7, further comprising the step of providing a spittoon alignable with the print head and adapted to receive ink ejected from the print head.

12. The apparatus of claim 7, further comprising the step of providing a capping station alignable with the print head for capping the print head.

* * * * *